US006994275B2

(12) United States Patent
Hsiao

(10) Patent No.: US 6,994,275 B2
(45) Date of Patent: Feb. 7, 2006

(54) PORTABLE PRESSURIZED CANISTER FOR INFLATING TIRES

(76) Inventor: Chung-Ji Hsiao, No. 88-16, Hsin-Chuang Village, Hsin-Chuang Lane, Lung-Chin Hsiang, Taichung Hsien (TW)

( * ) Notice: Subject to any disclaimer, the term of this patent is extended or adjusted under 35 U.S.C. 154(b) by 137 days.

(21) Appl. No.: 10/770,498

(22) Filed: Feb. 4, 2004

(65) Prior Publication Data

US 2005/0167528 A1 Aug. 4, 2005

(51) Int. Cl.
*A62C 13/62* (2006.01)
*B05B 1/30* (2006.01)
*B05B 7/30* (2006.01)

(52) U.S. Cl. ..... 239/302; 239/569; 239/581.1; 239/349

(58) Field of Classification Search ..... 239/302, 239/349, 357, 378, 569, 581.1; 222/382, 222/402.1, 402.13, 402.15, 464.1
See application file for complete search history.

(56) References Cited

U.S. PATENT DOCUMENTS

| | | | | |
|---|---|---|---|---|
| 4,684,032 A * | 8/1987 | Tsay | 215/389 |
| 5,244,117 A * | 9/1993 | Lombardo | 222/1 |
| 5,305,784 A * | 4/1994 | Carter | 137/231 |
| 5,309,669 A * | 5/1994 | Jackson | 43/124 |
| 5,765,601 A * | 6/1998 | Wells et al. | 141/38 |
| 6,260,739 B1 * | 7/2001 | Hsiao | 222/538 |

* cited by examiner

*Primary Examiner*—Davis Hwu
(74) *Attorney, Agent, or Firm*—Rosenberg, Klein & Lee

(57) ABSTRACT

A pressurized canister includes an outlet member on a top of the canister and a cap assembly is mounted to the canister. A rotatable member is threadedly connected to a threaded neck on the cap assembly and includes an extension which is able to engage with the outlet member by threading downward the rotatable member. The outlet member is pressed by the extension such that the pressurized air releases from the outlet member. A hose is connected to the extension and a nozzle is connected to the hose so that the pressurized air inflates a tire if the nozzle is connected to the valve of the tire.

5 Claims, 10 Drawing Sheets

PORTABLE PRESSURIZED CANISTER FOR INFLATING TIRES

FIELD OF THE INVENTION

The present invention relates to a portable pressurized canister having a cap movably connected to the canister so as to activate the valve to release the pressurized air in the canister without need of tools.

BACKGROUND OF THE INVENTION

A conventional pressurized canister is disclosed in FIGS. 6 and 7, and generally includes canister 53 with pressurized air filled therein and an outlet member 530 extends from a top of the canister 53. A cap assembly is mounted to the top of the canister 53 and includes a pushing section 52 which is mounted to the outlet member 530. A hose 521 is connected to the pushing section 52 so that when the outlet member 530 is pressed by the pushing section 52, pressurized air in the canister 53 releases from the hose 521 to inflate a tire. A cap member 51 is mounted to the top of the cap assembly. The conventional canister requires a continuous press to the pushing section 52 and this takes a lot of effort which is difficult for some of the users.

FIGS. 8 and 9A show another pressurized canister which includes a canister 63 with pressurized air filled therein and an outlet member 630 extends from a top of the canister 63. A cap assembly 62 includes a head cap 621 which is mounted to the top of the canister 63 and includes a chamber 622 for receiving an operation member 624 therein. The operation member 624 includes a protrusion 625 which is slid in a notch 623 defined in a neck of the cap assembly 62 and a hose 626 is connected to the operation member 624. A nozzle 627 is connected to distal end of the hose 626 and a cap 61 is mounted to the head cap 621 of the cap assembly 62. The user still has to press the operation member 624 continuously to activate the outlet member 630. FIG. 9B shows an alternative structure wherein the neck includes threaded inner periphery so that a threaded piece 628 is threadedly engaged with the threaded inner periphery of the neck. When the threaded piece 628 is rotated downward, the operation member 624 is pressed by the lowered threaded piece 628 such that pressurized air in the canister 63 releases from the outlet member 630, the hose 626 and the nozzle 627. Nevertheless, the threaded piece 628, the operation member 624 and the neck including the threaded inner periphery are manufactured individually so that the cost of manufacturing is so high that has less competitive value.

The present invention intends to provide a pressurized canister that is easily to use and involves less number of parts.

SUMMARY OF THE INVENTION

The present invention relates to a pressurized canister which comprises a canister filled with pressurized air and having an outlet member extending from a top thereof. A cap assembly is mounted to the top of the canister and includes a head cap and a threaded neck extends from a top opening of the head cap. A rotatable member is threadedly mounted to the threaded neck and has an extension which is sized to engage with the outlet member. An overhead portion is in communication with the extension and extends from a top of the rotatable member. A hose is connected to the overhead portion and a nozzle is connected to a distal end of the hose.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
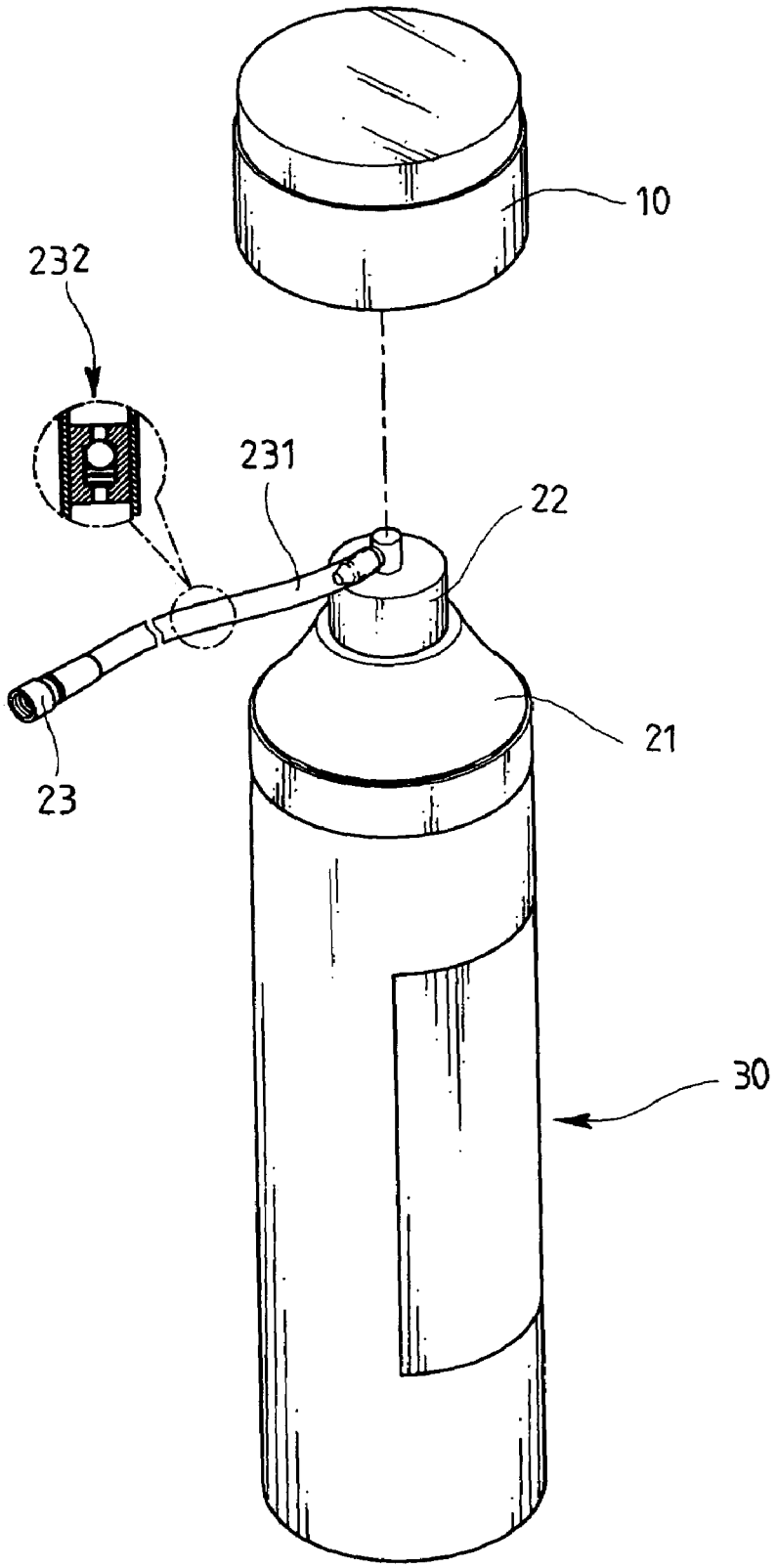
FIG. 1 shows the pressurized canister with a cap assembly and a cap of the present invention.
Figure 2:
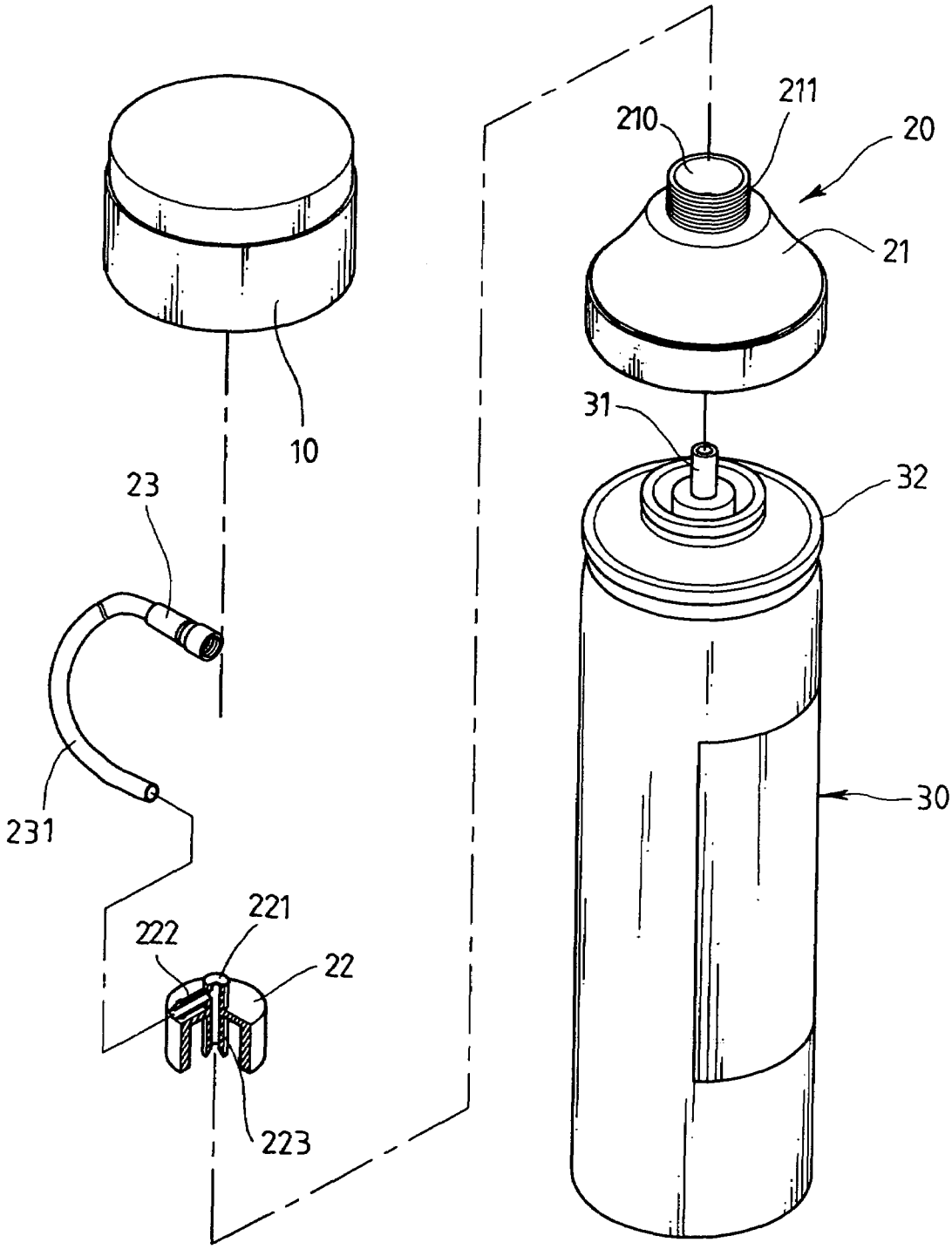
FIG. 2 is an exploded view to show the pressurized canister, the cap assembly and the cap of the present invention.
Figure 3A:
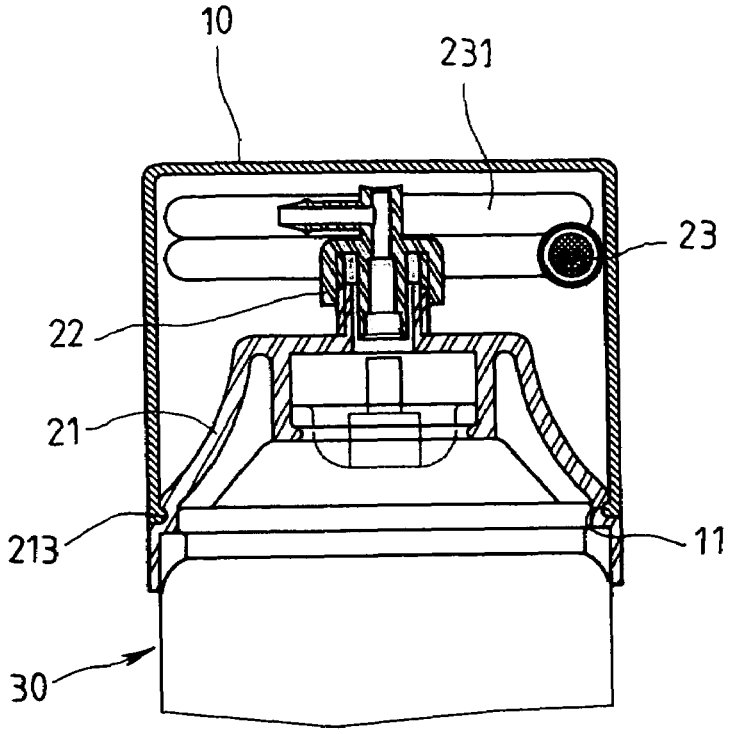
FIG. 3A shows the hose and the rotatable member are received in the cap mounted to the head cap.

Referring to FIGS. 1, 2 and 3A, the pressurized canister of the present invention comprises a canister 30 filled with pressurized air therein and has an outlet member 31 extending from a top thereof. The outlet member 31 is a valve which can be opened by being pressed. A flange 32 extends from an outer periphery of the canister 30 and cap assembly 20 is mounted to the top of the canister 30. The cap assembly 20 has a head cap 21 and a threaded neck 211 extends from a top opening 210 of the head cap 21. The head cap 21 is mounted to the flange 32.

A rotatable member 22 is threadedly mounted to the threaded neck 211 and includes an extension 223 extending from an underside thereof. The extension 223 is sized to engage with the outlet member 31 and an overhead portion 221 in communication with the extension 223 extends from a top of the rotatable member 22. The overhead portion 221 has a close top end and a tube 222 extends from an outer periphery thereof and is in communication with the overhead portion 221. The hose 231 is connected to the tube 222 and a nozzle 23 is connected to a distal end of the hose 231. A one-way valve 232 is received in the hose 231 so as to prevent the pressurized from going back to the canister 30. A cap 10 is mounted to the head cap 21 and a ridge 11 extends from an inner periphery of the cap 10. The head cap 21 has a groove 213 defined in an outer periphery thereof so that the ridge 11 of the cap 10 is engaged with the groove 213. The hose 231 can be received in the cap 10 when not in use as shown in FIG. 3A.

Figure 3B:
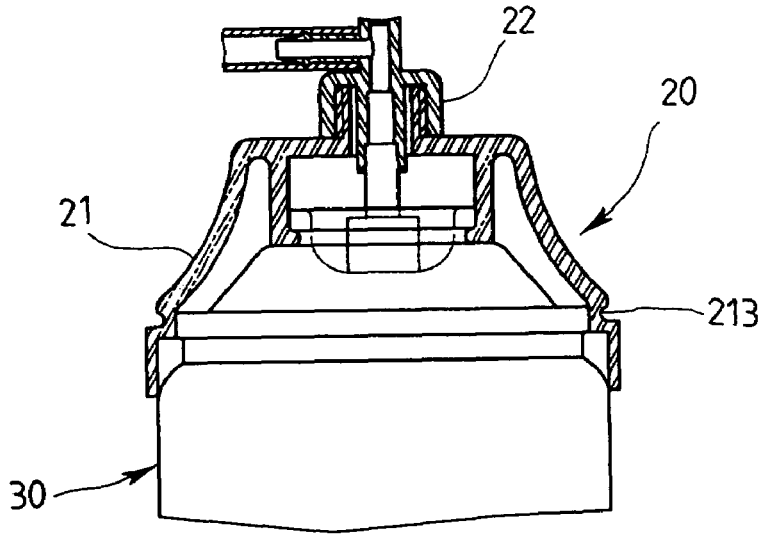
FIG. 3B shows the cap is removed from to the head cap.
Figures 4, 5A, 5B:
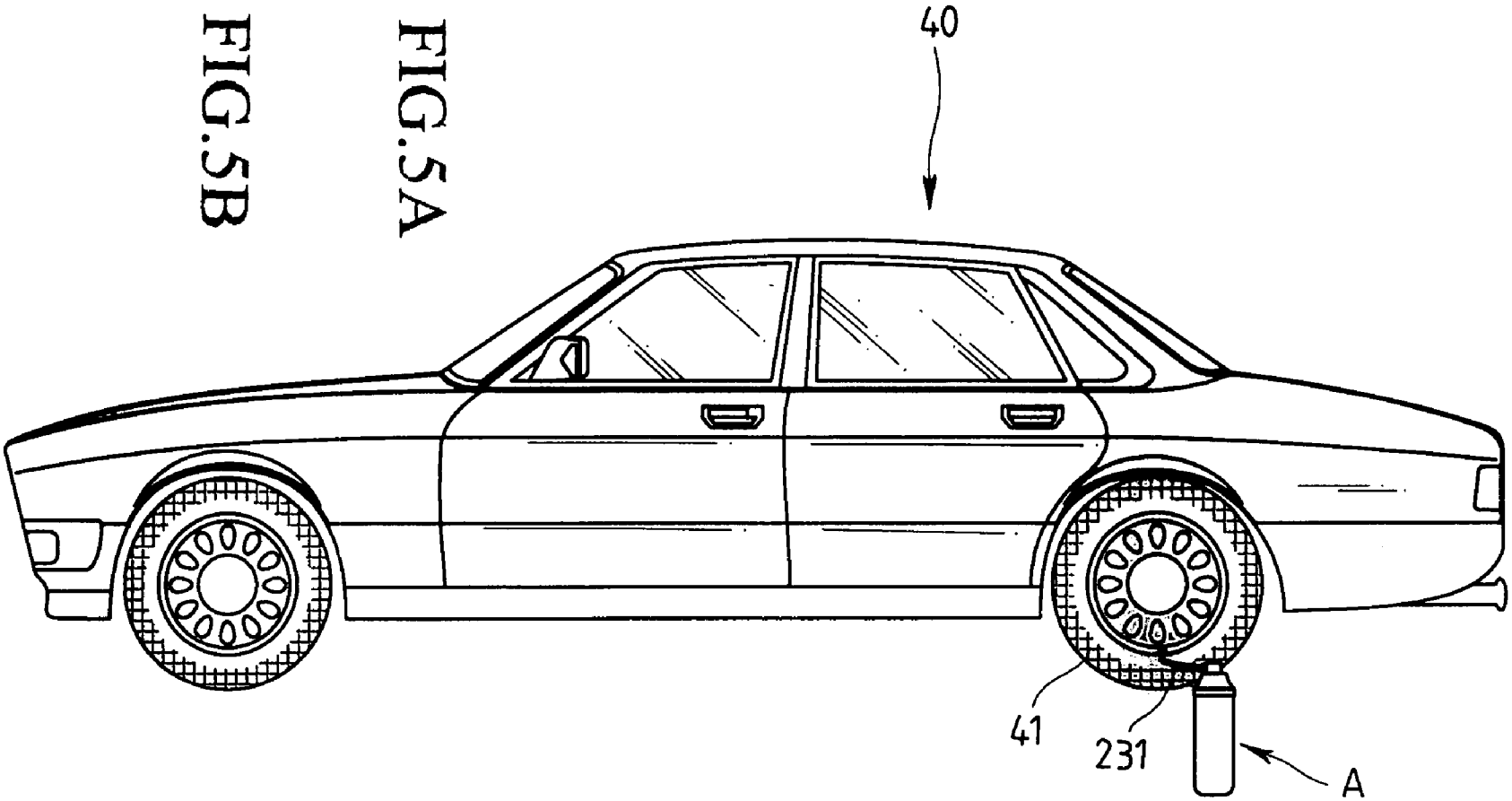
FIG. 4 shows the pressurized canister is used to inflate a tire.
FIG. 5A shows another embodiment of the connection of the hose and the rotatable member.
FIG. 5*b* shows the rotatable member is threadedly move downward.

Referring to FIGS. 3B and 4, when removing the cap 10, the user may connect the nozzle 23 to the valve of one of the tires 41 of a car. The rotatable member 22 is then rotated to engage the extension 223 with the outlet member 31 such that the pressurized air inflates the tire 41.

Figure 5A:
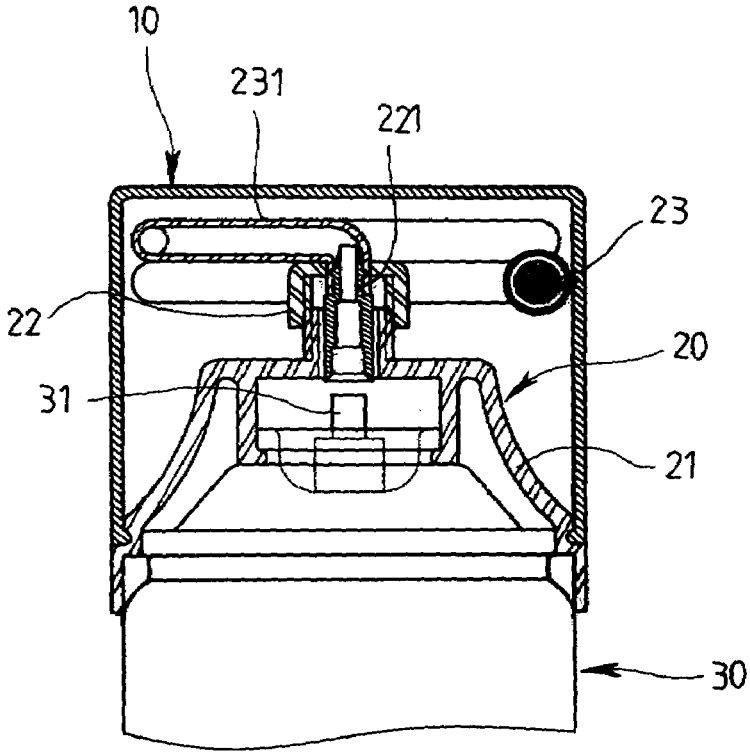
Figure 5B:
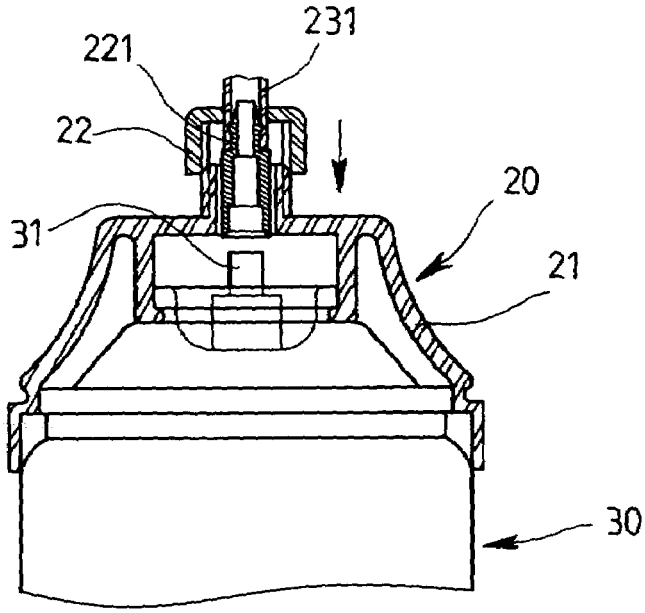
Figure 5C:
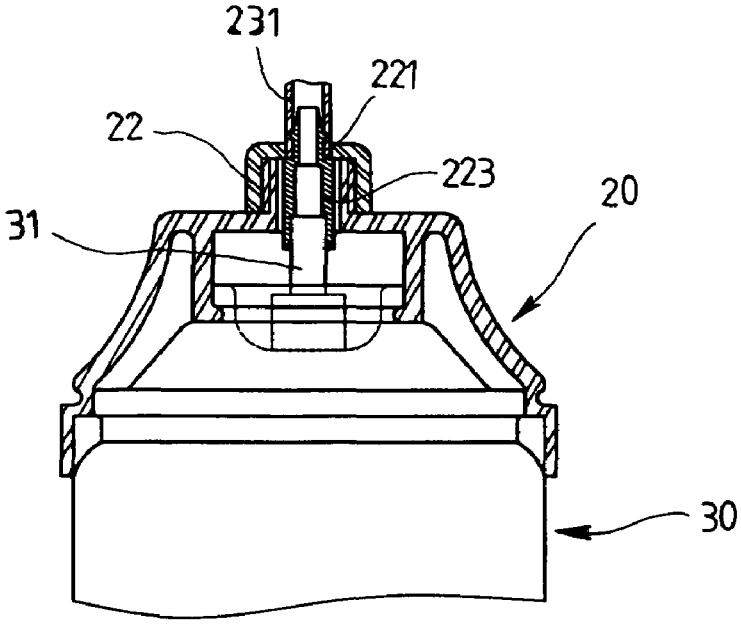
FIG. 5C shows the extension of the rotatable member is engaged with the outlet member of the canister.

Another embodiment of the present invention is disclosed in FIGS. 5A, 5B and 5C, wherein the overhead portion 221 has an open top end the hose 231 is connected to the open top end of the overhead portion 221. The extension 223 can be engaged with the outlet member 31 by rotating the rotatable member 22 downward.

Figure 5D:
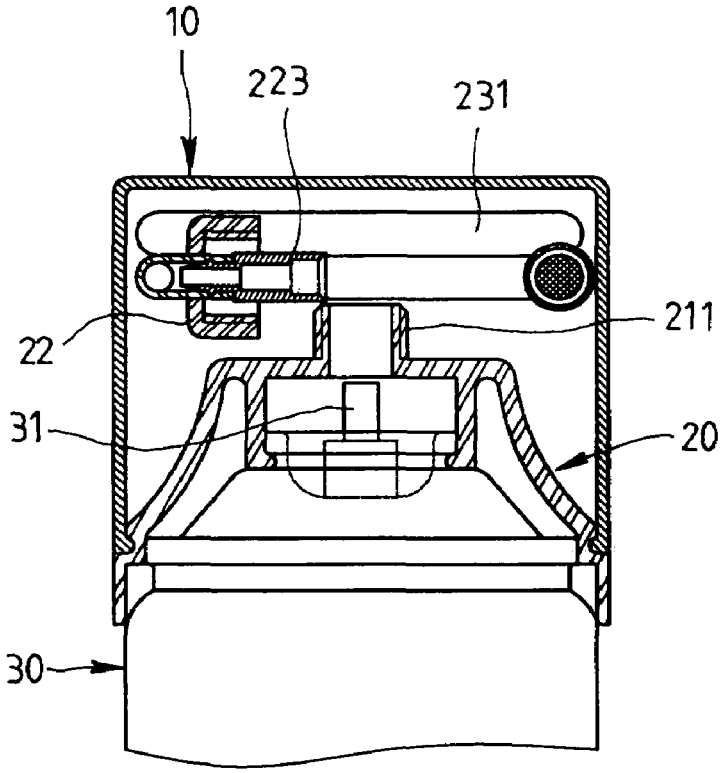
FIG. 5D shows the rotatable member and the hose can be disengaged from the rotatable member and received in the cap.
Figure 6:
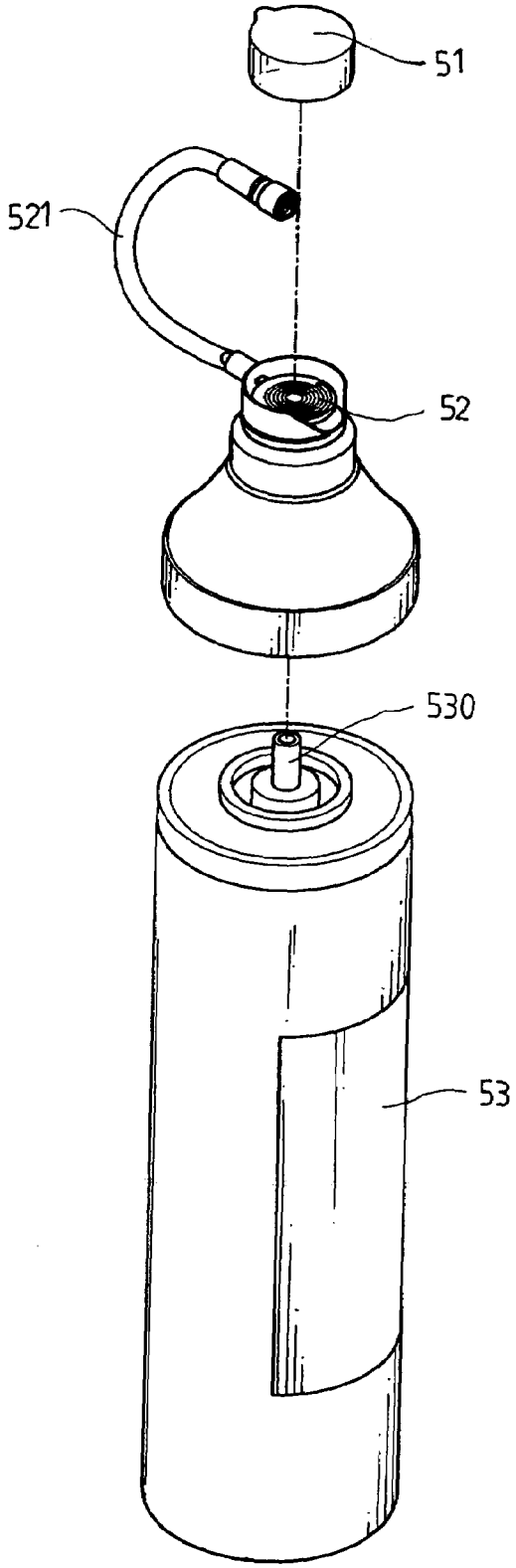
FIG.6 PRIOR ART
FIG. 6 shows an exploded view of a conventional pressurized canister.
Figure 7:
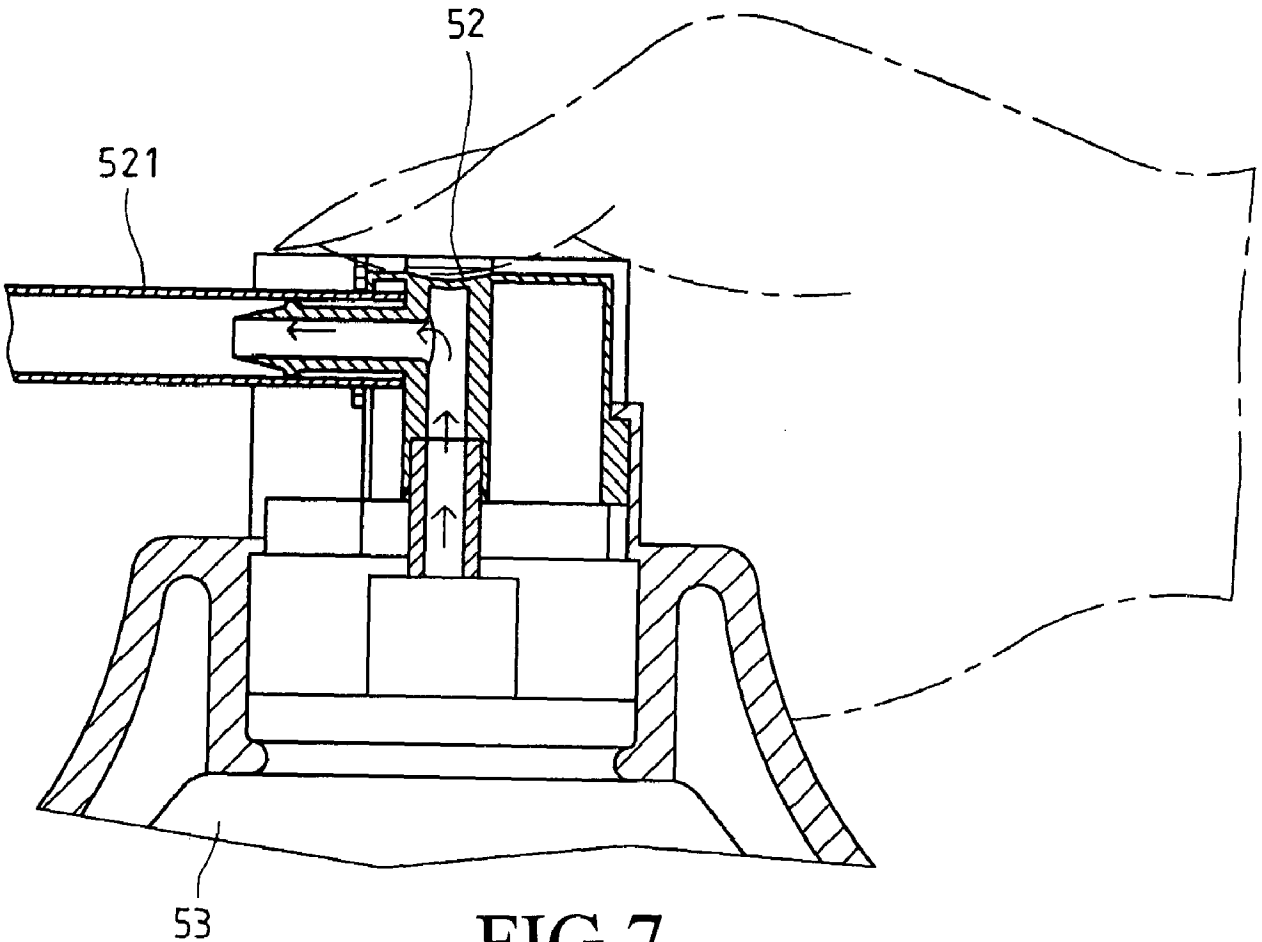
FIG.7 PRIOR ART
FIG. 7 shows the user presses the pushing section of the conventional pressurized canister as shown in FIG. 6.
Figure 8:
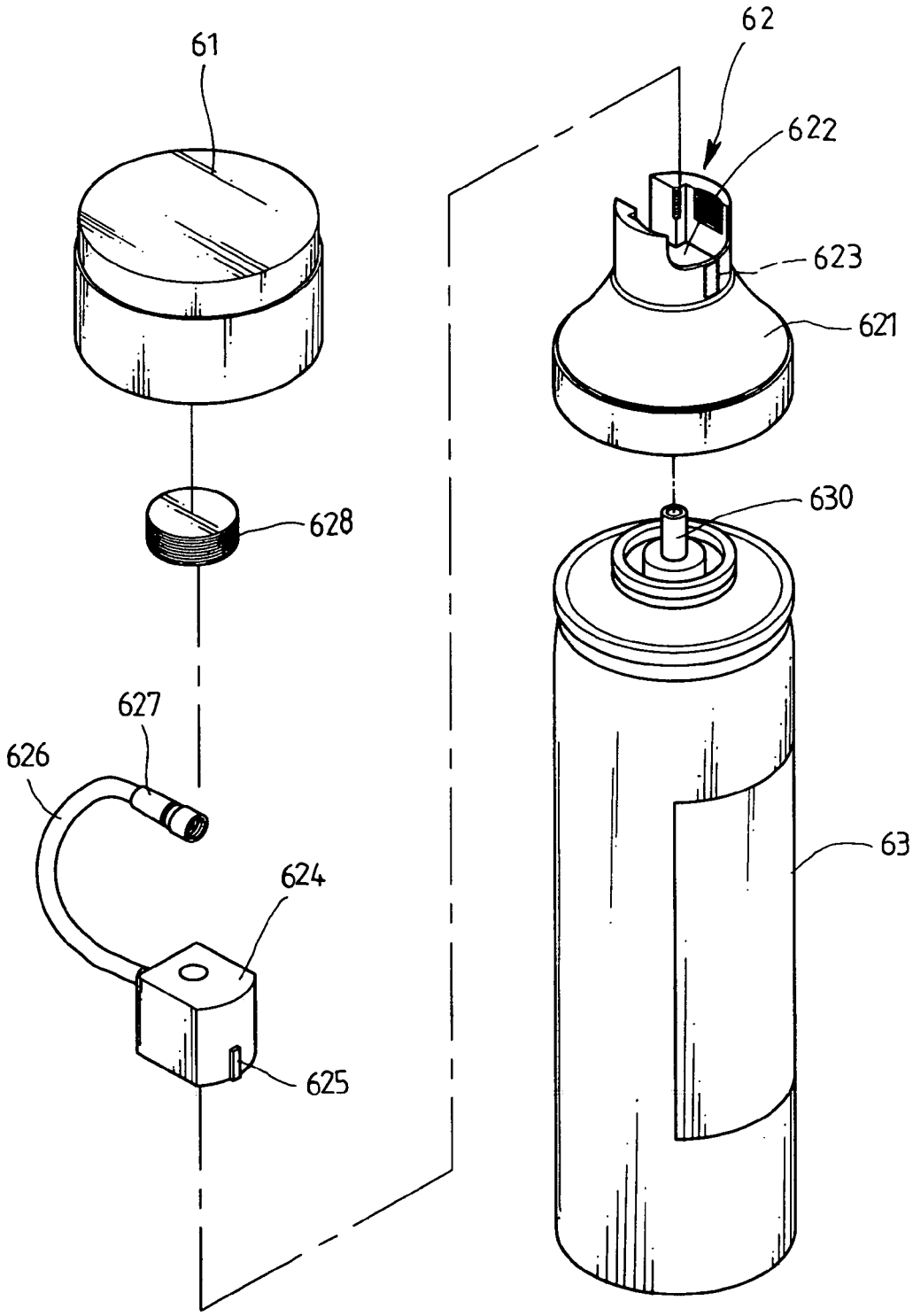
FIG.8 PRIOR ART
FIG. 8 shows an exploded view of another conventional pressurized canister.
Figure 9A:
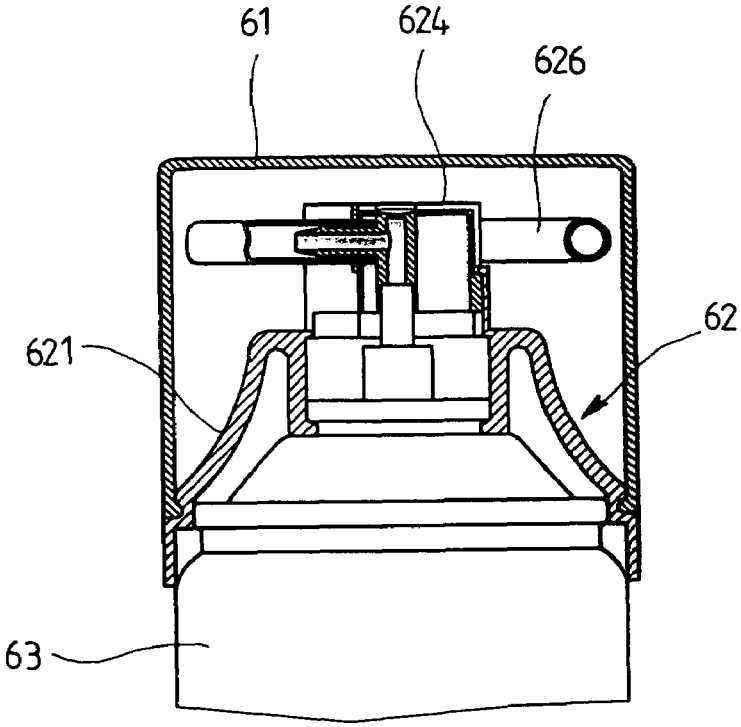
FIG.9A PRIOR ART
FIG. 9A shows a cap is mounted to the head cap of the conventional pressurized canister as shown in FIG. 8.
Figure 9B:
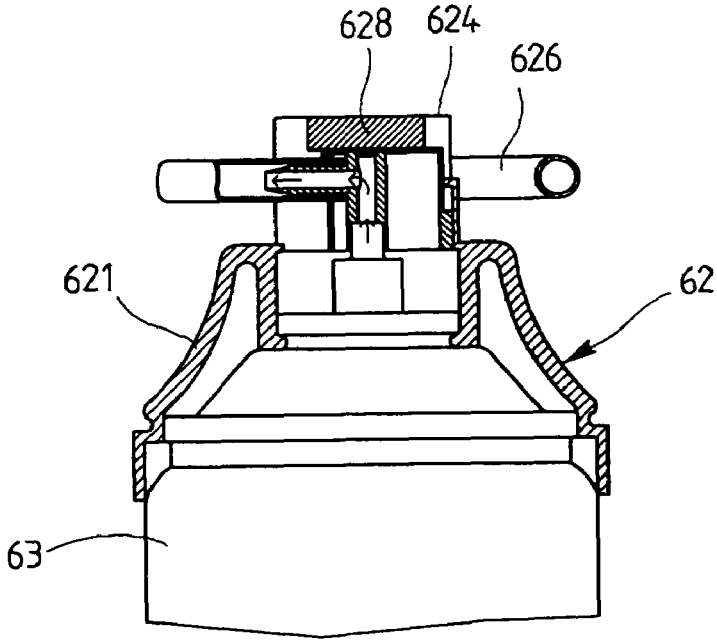
FIG.9B PRIOR ART
FIG. 9B shows the threaded piece is used to press the operation member of the conventional pressurized canister as shown in FIG. 8.

FIG. 5D shows that the rotatable member 22 together with the hose 231 can be removed from the threaded neck 211 and received in the cap 10.

While we have shown and described the embodiment in accordance with the present invention, it should be clear to those skilled in the art that further embodiments may be made without departing from the scope of the present invention.

What is claimed is:

1. A pressurized canister comprising:

a canister having an outlet member extending from a top thereof and a cap assembly mounted to the top of the canister, the cap assembly having a head cap and a threaded neck extending from a top opening of the head cap, a rotatable member threadedly mounted to the threaded neck and including an extension which is sized to engage with the outlet member, an overhead portion in communication with the extension and extending from a top of the rotatable member, a hose connected to the overhead portion and a nozzle connected to a distal end of the hose.

2. The canister as claimed in claim 1, wherein the overhead portion has a close top end and a tube extends from the an outer periphery thereof and is in communication with the overhead portion, the hose connected to the tube.

3. The canister as claimed in claim 1, wherein the overhead portion has an open top end the hose is connected to the open top end of the overhead portion.

4. The canister as claimed in claim 1, wherein a flange extends from an outer periphery of the canister and the head cap is mounted to the flange.

5. The canister as claimed in claim 1, wherein the head cap has a groove defined in an outer periphery thereof and a cap is mounted to the head cap, a ridge extending from an inner periphery of the cap and engaged with the groove.

* * * * *